United States Patent [19]

Takeshita et al.

[11] Patent Number: 5,048,878

[45] Date of Patent: Sep. 17, 1991

[54] STRIKER FOR LID OF FUEL INLET CHAMBER

[75] Inventors: Kazuhiro Takeshita, Utsunomiya; Tatsuo Chiura, Wako, both of Japan

[73] Assignee: Nippon Cable System Inc., Takarazuka, Japan

[21] Appl. No.: 466,531

[22] Filed: Jan. 17, 1990

[30] Foreign Application Priority Data

Apr. 27, 1988 [JP] Japan ..... 63-57019[U]
Apr. 26, 1989 [JP] Japan ..... 1-106521

[51] Int. Cl.[5] ..... E05C 1/12
[52] U.S. Cl. ..... 292/171
[58] Field of Search ..... 292/171, 341.15, DIG. 60, 292/137, 141, 143, 163-175; 70/DIG. 33, 256

[56] References Cited

U.S. PATENT DOCUMENTS

Re. 31,935 7/1985 Poe ..... 292/DIG. 60 X
2,572,730 10/1951 Jones et al. ..... 292/171
4,223,943 9/1980 Van Hulle et al. .... 292/DIG. 60 X
4,525,004 6/1985 Tanaka ..... 292/171
4,792,166 12/1988 Shiraishi et al. ..... 292/DIG. 60 X

FOREIGN PATENT DOCUMENTS 53-4512 1/1978 Japan .
57-59565 12/1982 Japan .

*Primary Examiner*—Richard E. Moore
*Attorney, Agent, or Firm*—Armstrong, Nikaido, Marmelstein, Kubovcik & Murray

[57] ABSTRACT

A striker for a lid of a fuel inlet chamber, which is remotely controllable through a control cable. The striker comprises a lock pin, a spring and an inner cable of the control cable. The lock pin is movable in the axial direction thereof and rotatable around a rotational axis, and the rotation of the lock pin can be locked to an aimed position. The lock pin is urged to be projected inside the fuel inlet chamber by the spring. The inner cable is used for withdrawing the lock pin backward.

3 Claims, 9 Drawing Sheets

STRIKER FOR LID OF FUEL INLET CHAMBER

BACKGROUND OF THE INVENTION

The present invention relates to a striker for a lid of a fuel inlet chamber, and more particularly, to a remote control type of striker which locks a latch of a lid of a fuel inlet chamber to keep the lid closed, and is operated through a control cable to release the locking.

There has been known a conventional striker, with which a lock of a lid of a fuel inlet chamber is released from a driver's sheet by remote-controlling through a control cable.

Such a striker described above is disclosed in, for example, Japanese Unexamined Utility Model Publication No. 4512/1988.

The striker, as shown in FIG. 10, comprises a lock housing 51, a joint member 52 provided slidably in the lock housing 51, and a spring 54 provided in the lock housing 51. The lock housing 51 has a base end attached to an end of a control cable, and the lock housing 51 is provided with a catching member 4 and a through hole 5 on a free end thereof.

An inner cable 36 (core cable) of the control cable is connected with an end of the joint member 52, and a lock nail (lock pin) 53 is provided on the other end of the joint member 52. The lock nail 53 is inserted through the hole 5 and projects outward from the lock housing 51. The spring 54 urges the lock nail 53 in such direction that the nail projects outward from the lock housing 51.

In the above-mentioned conventional striker, it is very difficult to make even an outer surface of the lid to the surface of a body of an automobile around the lid, when the lid is attached to the fuel inlet chamber in an assembly of an automobile, or the like. In particular, after closing the lid, the striker cannot be easily moved because of the design thereof, although a hinged side of the lid can be adjusted by selecting the fixing position of the hinge or the like.

As a result of the above, it is very difficult to make the outer surface of the lid even to the surface of the automobile around the fuel inlet chamber, and it is necessary to prepare a careful design and production management.

The object of the present invention is to solve the above problems and to provide a striker in which position of a lock pin can be easily adjusted.

SUMMARY OF THE INVENTION

In accordance with the present invention, there is provided a striker for a lid of a fuel inlet chamber, comprising a lock pin, a spring and a controlling member. The lock pin is provided in a wall of the fuel inlet chamber and is axially slidable so as to project into the chamber. The spring urges the lock pin in the inside direction of the chamber. The controlling member is for pulling the lock pin backward against the spring. The striker of the present invention is characterized in that the lock pin is supported rotatably around an axis eccentric with respect to the center axis thereof and is slidable in a direction of the axis thereof, and that the striker has a means for restricting a rotation of the lock pin at a desired angle.

In the above mentioned striker, the supporting means of the lock pin can be formed as a through hole formed in an end of a casing which is provided rotatably in the wall of the chamber. In that structure, the above-mentioned through hole is eccentric with respect to the rotating axis of the casing, and a means for fixing the casing to a wall is used as the restricting means.

Supporting means for the lock pin of the striker can be also formed as a hole in a bushing provided rotatably on the end of the casing to be fixed in the wall. In this structure, the hole is eccentric with respect to the rotational axis of the bushing, and a means for locking the rotation of the bushing with respect to the casing is provided as the restricting means.

Such locking means can be constructed by making the bushing and the casing to be abutted with each other at their contacting surfaces perpendicular to their axes, forming a set of engaging grooves radially extending on one of the contacting surfaces of the bushing or the end of the casing, forming a set of engaging projections radially extending on the other, and engaging the grooves and projections with each other, and securing them to each other by an elastic member.

Furthermore, as the means for supporting a lock pin in the basic model of striker described above, a sliding member rotatably and slidably inserted in a casing fixed to the wall and having a lock pin on the head thereof can be employed. In this structure, the lock pin is eccentric with respect to the rotational axis of the sliding member, and an engaging means which locks the rotation of the sliding member when the lock pin is projected out and admits the rotation of the sliding member when the lock pin is withdrawn is used as a locking means.

In this type of striker, a set of radial grooves for clicking provided on the bottom face of the casing or the contacting face of a clicking member being in contact with the bottom face of the casing, and radial projections for clicking on the other are preferably used.

When the casing is turned with respect to the wall, or when a bushing having an eccentric hole or a bushing eccentric with respect to the casing fixed in the wall is turned, the lock pin moves relative to the wall, since the lock pin is located eccentrically with respect to the rotational axis thereof.

As a result, the height of the lid surface can be easily adjusted with regard to the surface of a body of an automobile around the lid by adjusting the position of the lock pin when the lid is attached to the fuel inlet chamber in an assembling process of the automobile.

After the lid is attached, the striker can be operated through the control cable, and the same function as of conventional striker can be obtained. That is to say, when a pulling member such as a core cable is pulled, the lock pin is drawn back to disengage the locking between latch of the lid and the lock pin. When the pulling force is loosened, the spring urges the lock pin to project for allowing the next locking operation of the lid.

DETAILED DESCRIPTION

At first, a first embodiment of the striker of the present invention is described with reference to FIG. 1 and FIG. 2.

The numeral 3*a* shows a casing body having a cup-like shape, which composes a casing 3 together with a cap 10 to be fixed on an open end thereof.

Figure 9:
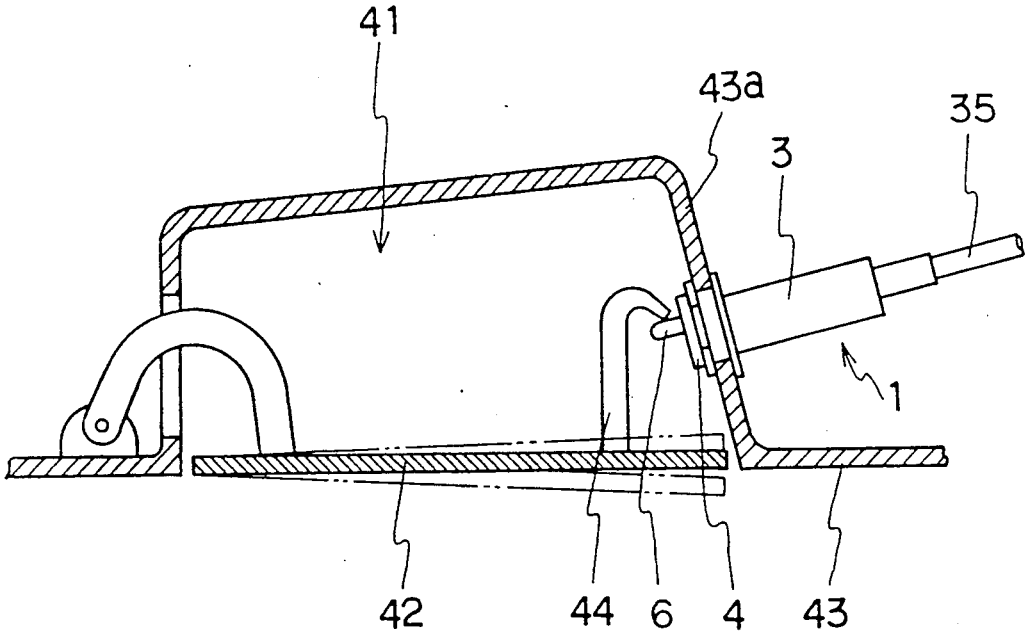
FIG. 9 is a sectional view showing an embodiment of the striker of the present invention in a state equipped on a body of an automobile.
Figure 10:
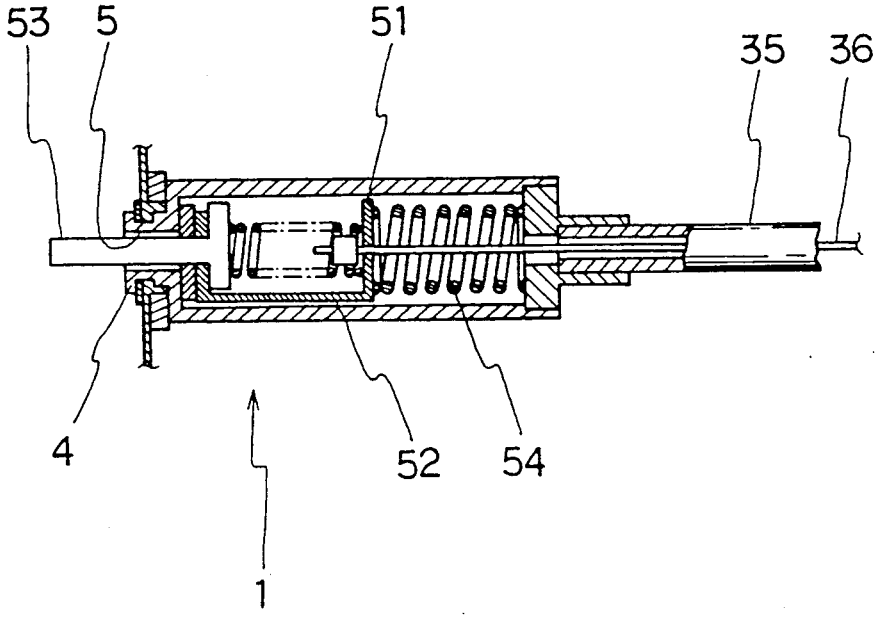
FIG. 10 PRIOR ART
FIG. 10 is a sectional view showing an example of the conventional strikers.

On the forward end (left hand side in FIG. 2), the casing body 3*a* is provided with a co-axial fixing portion 4 for fixing itself to a wall (the numeral 43 *a* in FIG. 9) of a fuel inlet chamber, and a through hole 5 is formed in the axial direction of the casing. An end of a conduit 35 of a control cable is fixed on the cap 10. On the outside periphery of the open end of the casing body 3*a*, catches 9*a* are provided for catching the cap 10.

A sliding member 7 is housed in the casing 3 in slidable manner in the axial direction. The sliding member 7 has a recessed portion or slot 7*a* for catching a nipple 36*a* fastened on the end of the inner cable 36, and has a lock pin 6. The lock pin 6 is inserted through the hole 5 and projects out of the casing 3.

Furthermore, a coil spring 8 for urging the lock pin 6 in such direction that the pin 6 projects out of the casing 3 is inserted in the casing 3, and is held with the cap 10. In the above mentioned structure, the fixing portion 4 is attached to the wall 43*a* so that the casing 3 is adjustable for rotation, and the center axis of the hole 5 is eccentric with respect to the axis (the rotational axis) of the casing 3 and the fixing portion 4.

Furthermore, a means for locking the rotation thereof with respect to the wall 43*a* is provided on the fixing portion 4. The locking means is, for example, friction members, lock nuts or serrated portions (not shown in the drawings).

The hole 5 is formed eccentrically with respect to the rotational axis of the casing 3, and therefore, the distance between the surface of the automobile body 43 and the lock pin 6 can be changed, and the closed position of the lid 42 can be adjusted by turning the casing 3 to a suitable angle with respect to the wall 43*a*.

After adjusting the angle, the casing 3 should be locked with a locking means in order not to allow natural rotation.

After mounting the striker, the lock pin 6 can be operated through the inner cable as is in the known strikers.

Figure 1:
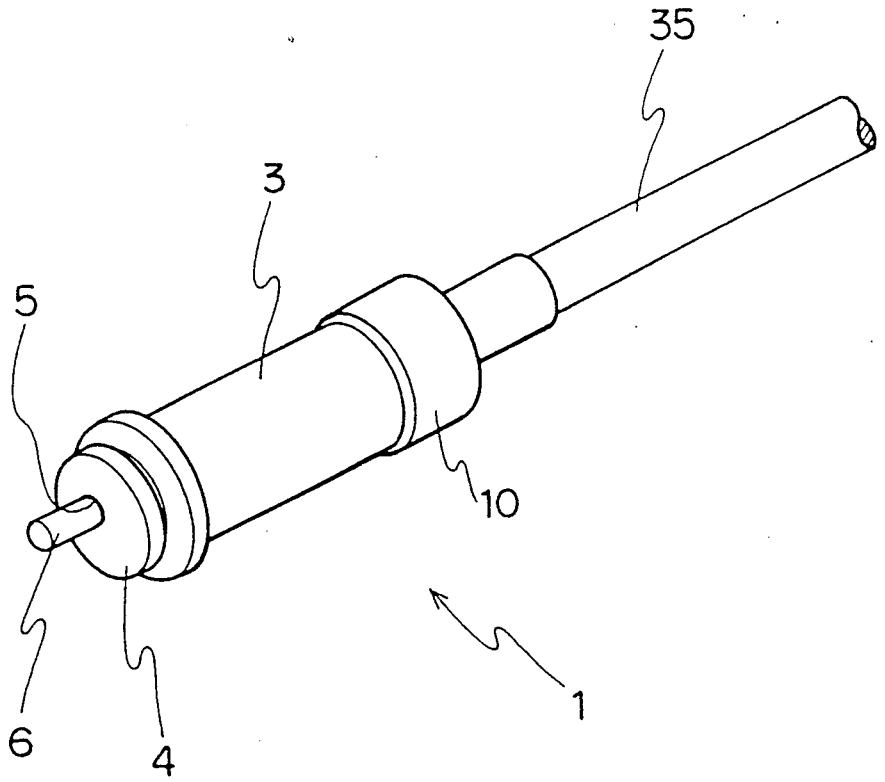
FIG. 1 is a perspective view showing a first embodiment of the striker of the present invention.
Figure 2:
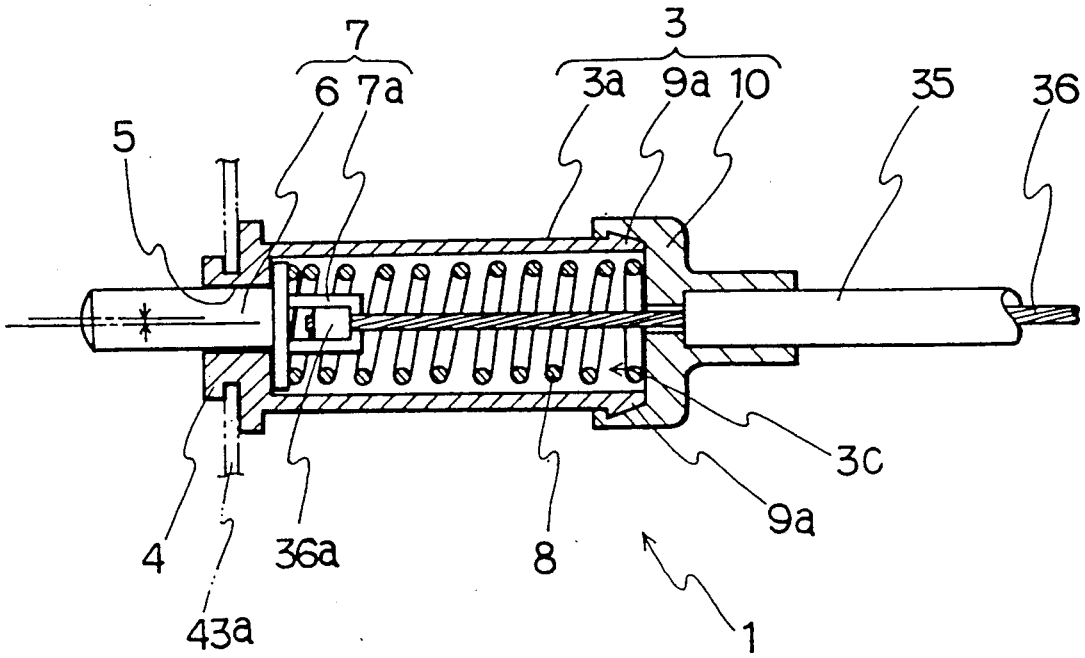
FIG. 2 is a longitudinal sectional view of the striker shown in FIG. 1.
Figure 2A:
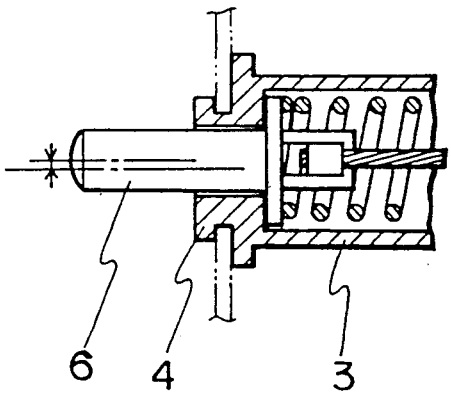
FIG. 2*a* is a sectional view showing a second embodiment of the striker of the present invention.

In the striker 1 shown in FIG. 1 and FIG. 2, the fixing portion 4 is coaxial with the casing. However, when the lock pin 6 is located coaxially with the casing 3 and the fixing portion 4 is formed eccentrically with respect to the casing, the same functions as described with reference to the striker 1 of FIG. 1 can be obtained.

Next, a second embodiment of a striker 1*a* shown in FIG. 3 and FIG. 4 will be described. The construction of this type of striker is almost the same as that of the striker shown in FIG. 1 and FIG. 2 excepting a bushing 12.

A hole 11 for inserting a bushing 12 is formed in the end of the casing 3, and a bushing 12 is inserted in the hole 11 such that the bushing 12 is rotatable and is able to be locked at a required turned point (angle) in the hole 11. The above-mentioned bushing 12 is formed with a through hole 5 for supporting the lock pin in a slidable manner in the axial direction thereof, and the axis of the hole 5 is eccentric with respect to the axis of the hole 11 for the bushing 12, i.e. the rotational axis of the bushing 12.

In the above-mentioned striker, the casing 3 is fixed to the wall 43*a*, and the bushing 12 can be turned and locked on the aimed position (angle). Accordingly, the distance between the lock pin 6 and the face of the body 43 can be adjusted by rotating and locking the bushing 12.

Figure 3:
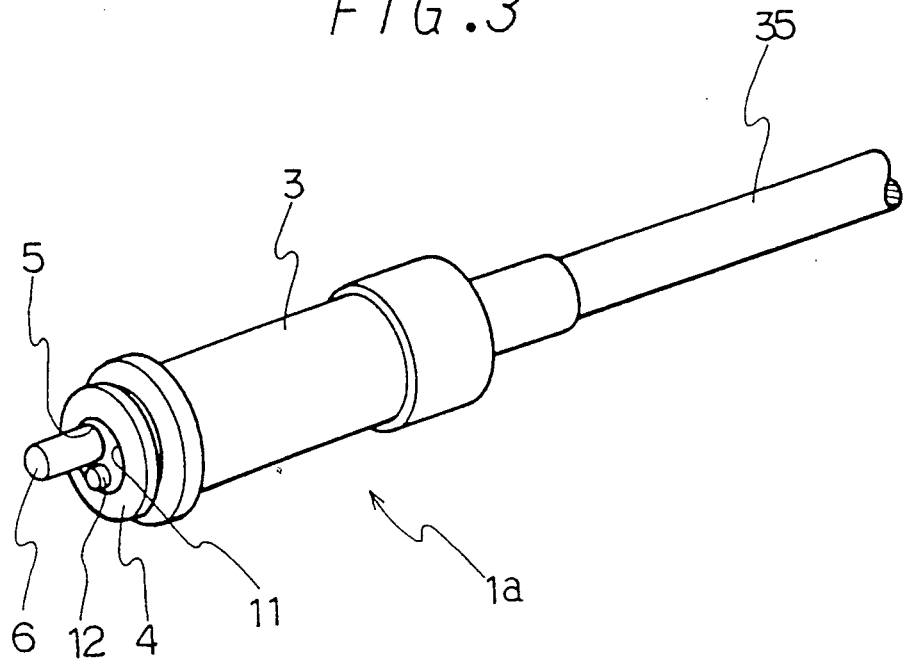
FIG. 3 is a perspective view showing a third embodiment of the striker of the present invention.
Figure 4:
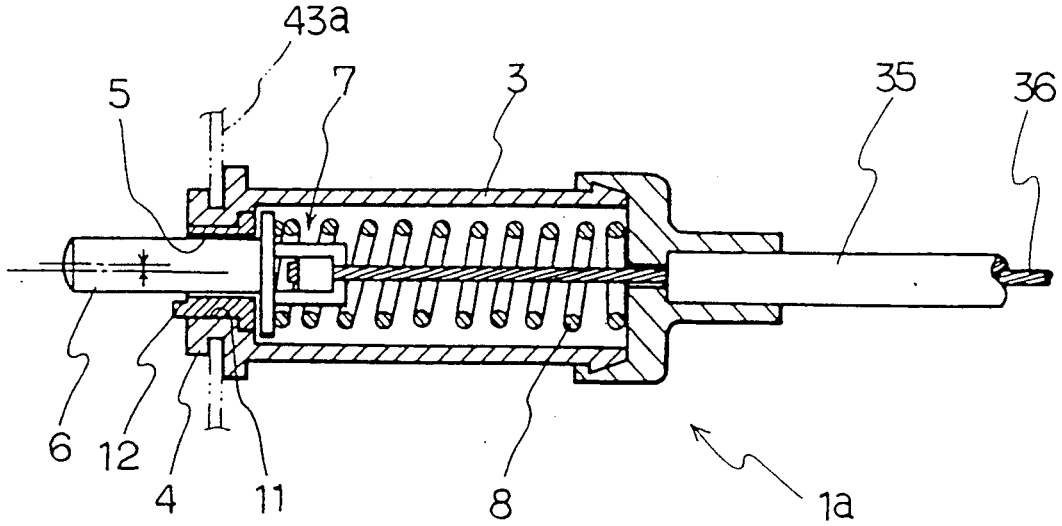
FIG. 4 is a longitudinal sectional view of the striker shown in FIG. 3.
Figure 5:
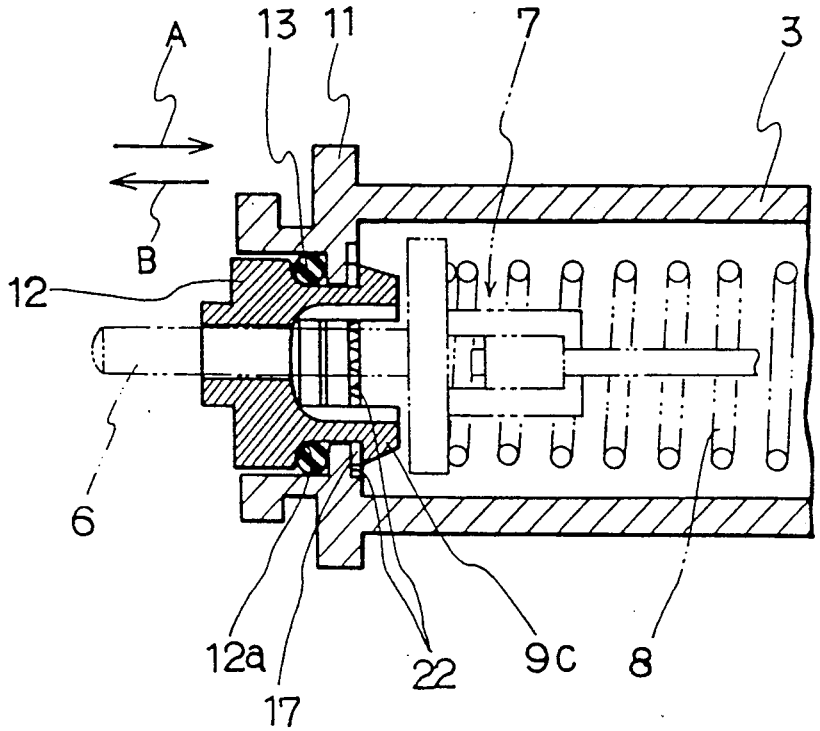
FIG. 5 is a sectional view showing an example of an adjusting mechanism for adjusting rotation of a bushing in the present invention.

FIG. 5 shows an example of a mechanism for adjusting the rotation of the bushing in the striker 1*a* shown in FIG. 3 and FIG. 4.

The bushing 12 has a flange or step 12*a* in order to hold an elastic or elastomeric ring 13 between the inner surface of the bottom end of the casing 3 and itself. A set of catches 9*c* are provided on the end of the bushing 12 in order to hook itself elastically on the inner surface of the bottom end of the casing 3.

A set of radially extending slots 22 are formed in the inside surface of the bottom end of the casing 3, and radial projections 17 capable of mating with the radial slots 22 are formed in the steps of the catches 9*c* which are in contact with the radial slots 22.

In the above-mentioned striker, when the bushing 12 is pushed in the direction of arrow A as deforming the elastic ring 13, the engagement between the projections 17 of the catches 9*c* of the bushing 12 and the slots 22 of the casing 3 comes off, and the bushing 12 becomes to be rotatable.

After the bushing is turned to a desired position in the above condition, the pushing load in the direction of arrow A is released. As a result, the bushing 12 comes back in the direction of arrow B by the eleastic force of the elastic ring 13 and the projections 17 come to be engaged with the slots 22. As mentioned above, the adjustment for the height of the lid is easy, and the adjusted position of the lid is kept steady even if the bushing is vibrated by the vibration of the automobile.

When the bushing is pushed in the direction of arrow A, the sliding member 7 is moved in the same direction. When the pushing force is reduced, the sliding member 7 is returned in the direction of arrow B by the spring 8.

Next, a third embodiment of the striker 1*b* of the present invention will be described with reference to FIGS. 6 through 8.

Figure 6:
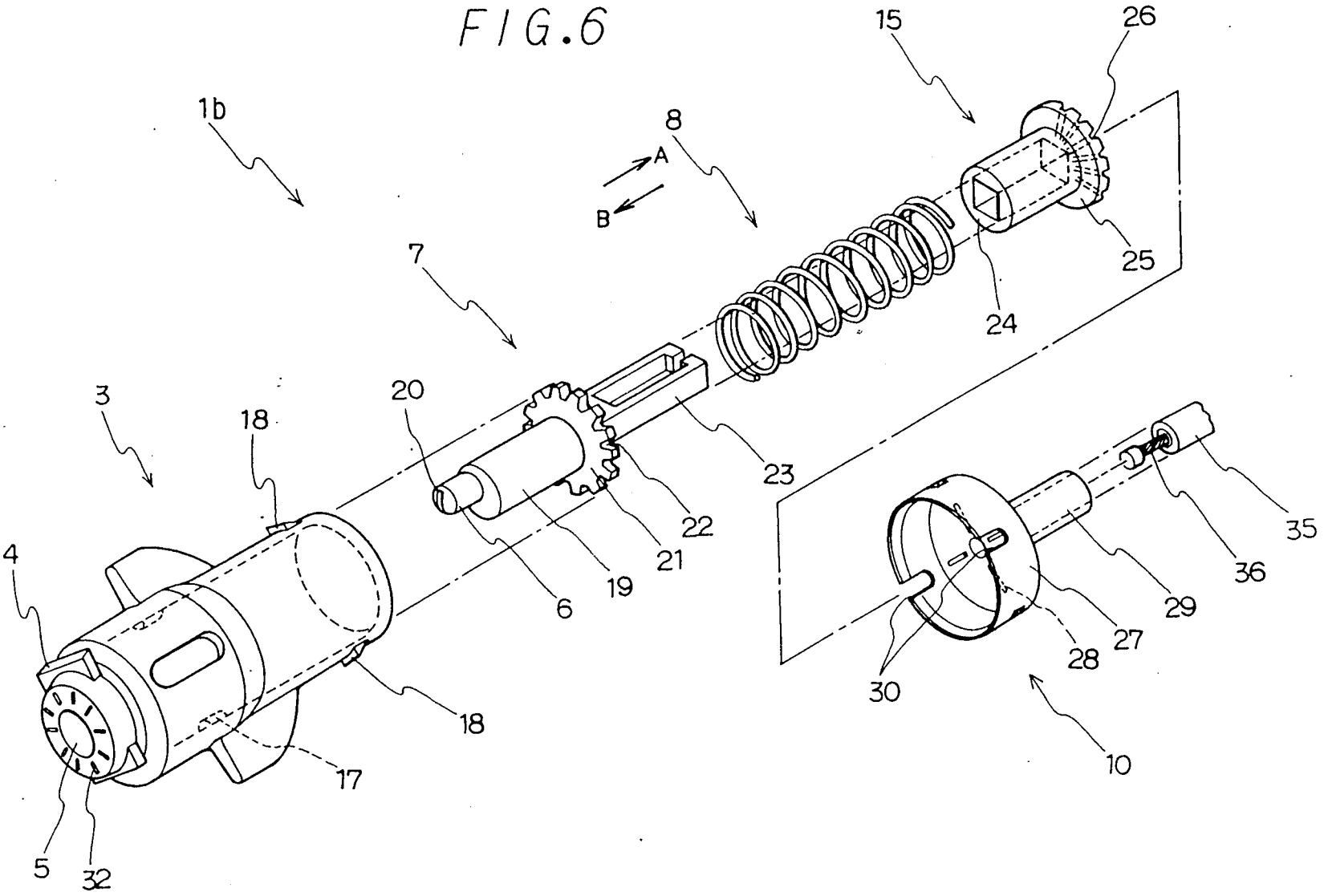
FIG. 6 is a perspective view showing a fourth embodiment of the striker of the present invention;.

In FIG. 6, the numeral 3*a* shows a casing body having a cylindrical shape with a bottom which has a through hole 5. A fixing member 4 is provided on the outer peripheral surface of the bottom end of a casing body 3*a* in order to fix the casing body 3*a* on a wall (the numeral 43*a* in FIG. 9). On the outside peripheral surface of the opening end of the casing body 3*a*, catches 18 are provided for catching or hooking a cap 10. On the inside surface near the bottom end of the casing body 3*a*, two projections extending in the axial direction of the casing body 3*a* are provided.

A sliding member 7 is inserted in the casing 3 in a slidable manner. The sliding member 7 comprises a flange 21 provided on the middle part thereof, a shaft having a circular cross section provided on one side of the flange 21, and another shaft having a square cross section provided on another side thereof.

The peripheral surface of the flange 21 is in contact with the inner surface of the casing 3 and slides along the inner surface. On the peripheral surface of the flange 21, slots 22 engageable with the projections 17 are provided.

The shaft 19 is inserted into the hole 5 in axially slidable manner and in rotatable manner. On the end of the shaft 19, a lock pin 6 engageable with a latch (the numeral 44 in FIG. 9) of the lid 42 is projected. The lock pin 6 is located eccentrically with respect to the rotational axis of the shaft 19. The peripheral surface of the lock pin 6 does not project outward from the peripheral surface of the shaft 19. A slit 20 for engaging with a screw driver is formed in the top of the lock pin 6.

The shaft 23 has a recessed portion 7*a* at an end thereof to which an inner cable 36 of the control cable is engaged.

The shaft 23 is inserted into a tubular click member 15 which is slidable on the outer surface of the shaft 23 in the axial direction. The click member 15 has a through hole 24 having the same square cross section as that of the shaft 23 in order to guide the axial relative motion between the shaft 23 and the click member 15. The shaft 23 corotates together with the click member 15. The click member 15 has a circular flange-like plate 25 on an end thereof. On the rear side of the plate 25, a set of click slots are formed so as to extend radially with the same angular pitch as that of the slots 22.

A coil spring 8 is provided between the flange 21 and the circular plate 25. By the spring 8, the sliding member 7 is urged frontward (in the direction of arrow B) and the click member 15 is urged backward (in the direction of arrow A).

The above-mentioned cap 10 has a connection portion 29 to be connected with an end of a conduit 35 of a control cable and has a bottom wall 27 for closing the opening end of the casing body 3*a*. In the inner surface of the bottom wall 27, four click projections engageable with the click slots are radially provided. The angular positions where the click slots 26 engage with the click projections 28 are corresponded with the angular positions where the slots 22 of the flange 21 engage with the projections of the casing 3.

The cap 10 is mounted on the casing 3 in such manner that the end opening of the casing body 3*a* is closed with the bottom wall 27 and the catches 18 of the casing 3 are engaged with holes on the side surface of the bottom wall 27. The circular plate 25 of the click member 15 is elastically abutted against the bottom wall 27 of the cap 10 in the mounted condition.

Next, the mounting method on an automobile body and adjusting method of the above-mentioned striker is described with reference to FIG. 7 and FIG. 8.

At first, the casing 3 is fixed on a wall 43*a* with the fixing portion 4 of the casing 3. Next, a screw driver or the like is abutted against the slit 20 of the lock pin 6, and the lock pin 6 is pushed against the spring force of the spring 8. Then, the sliding member 7 is forced to move in the direction of arrow C. As a result, the shaft 23 is pushed into the hole 24 of the click member 15, and the engagement between the projections 17 inside the casing and the slots 22 of the sliding member is released.

Under the above condition, the position of the lock pin 6 is adjusted by rotating the sliding member 7 with the screw driver. The click member 7 is also rotated with keeping the abutment between the click projections 17 and the slots 22.

Hence, the operator can get a feeling of clicks on his fingers occurring when the click slots is engaged with or disengaged from the click projections, and can presume practically the eccentric distance of the lock pin 6. The lock pin 6 is turned intermittently, making click feeling at each engagement between the click slots 26 and the click projections 28.

Figure 7:
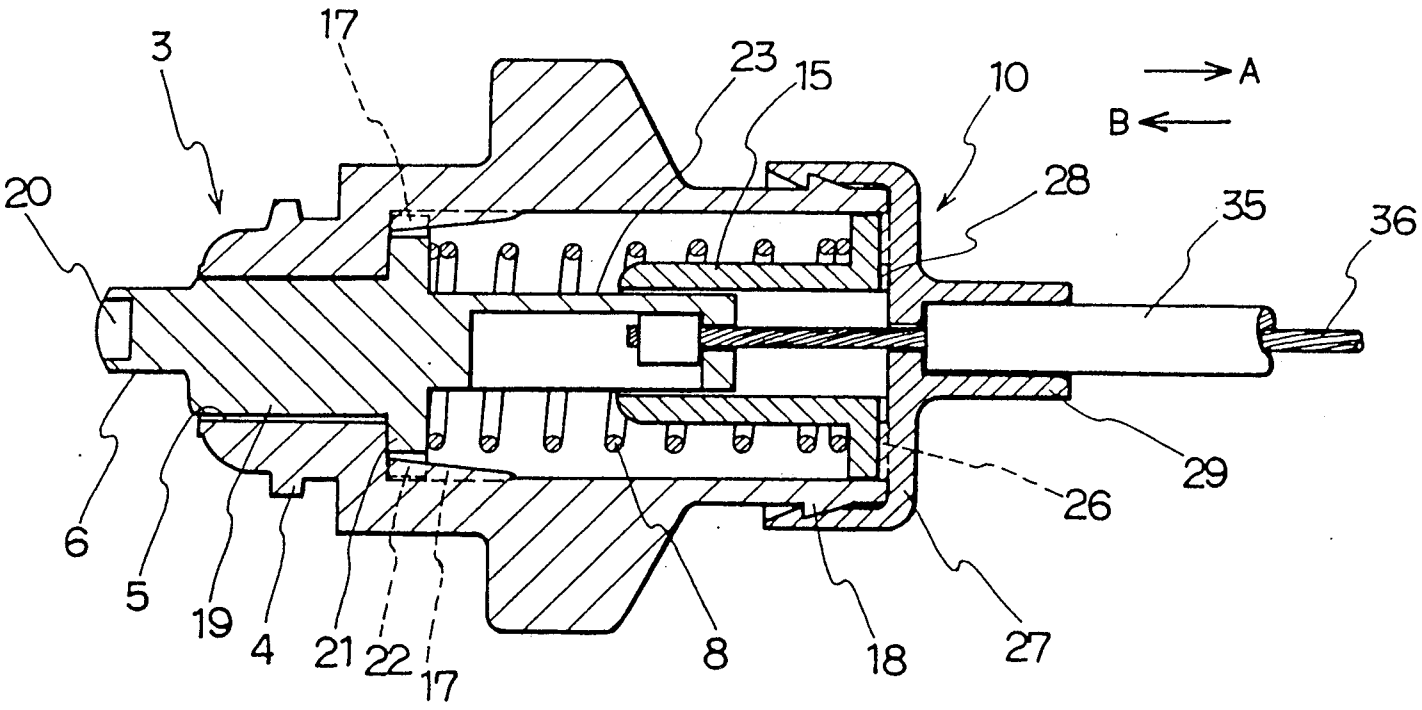
FIG. 7 and FIG. 8 are sectional views showing the operation of the striker shown in FIG. 6.
Figure 8:
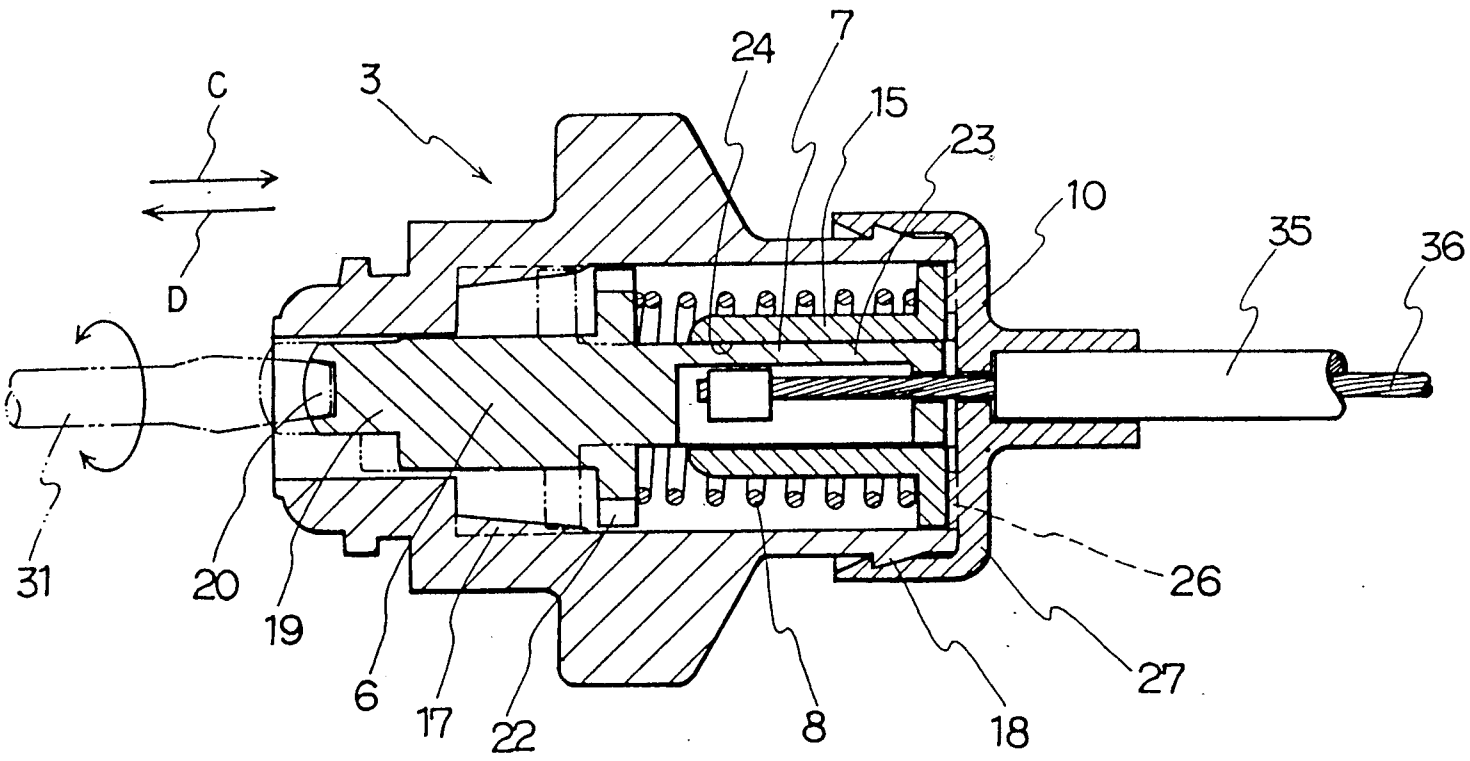

Next, when the pushing force applied on the lock pin in the direction of arrow C with the screw driver is released, the sliding member 7 is withdrawn frontward by the force of the spring 8 in the direction of arrow D as shown in FIG. 7. On the above instant, the slots 22 and the projections 17 are reengaged smoothly with each other, since angular positions of the click slots 26 correspond with that of the slots 22. Concurrently with the above, the lock pin 6 is reprojected out of the casing 3 through the hole 5, and the adjustment is finished.

If the lock pin 6 would not be set on the appropriate position in the first trial of adjustment, the adjustment is repeated through the above-mentioned manner until the locking pin 6 is set on the aimed position. After the above adjustment is completed, the sliding member 7 is forced to be in contact with the end of the casing 3 by the force of the spring 8, and the flange 21 is in contact with the inner surface of the region near the end of the casing 3. Since the slots 22 in the outside surface of the flange 21 are engaged with the projections 17, the sliding member is prevented from being turned by the vibration due to an external force.

Under the above situation, the lock pin 6 is withdrawn into the casing 3 by pulling the inner cable 36 in the direction of arrow A, and is projected out of the casing 3 by the spring load of the spring 8 when the pulling force is released. For the striker shown in FIG. 6. through FIG. 8, it is advantageous that a scale 32 is marked on the end surface of the casing, and the scale 32 preferably corresponds to the set of slots 22 in order to indicate the turning position of the lock pin 6. Owing to the above, as turning the lock pin, it is easy to presume the turned angle and the eccentric dimension of the lock pin. Then, the adjustment is easily performed.

Though the shaft 23 of the sliding member 7 shown in FIG. 6 is of a square cross section, it is to be understood that the cross section of the shaft 23 in the present invention is not limited to be of square. It can be of triangular, hexagonal, or another type of cross section as far as the sliding member can be turned with the click member 15.

Although the spring 8 in the present invention is also not limited to be of coil spring type, a coil spring is preferably provided between the circular plate 25 of the click member 15 and the flange 21 of the sliding member 7. In that case, a single spring can effect for operating the control cable (to return the inner cable) and also for adjusting the position of the lock pin (to return the sliding member).

Since the relation between the slots 22 of the flange 21 and the projections 17 of the casing 3 is in relatively, it can be accepted that the slots are provided on the inner surface of the casing 3 and the projections are provided on the flange 21. The above-mentioned substitution is also applied to the relation between the click slots 26 and the click projections.

The striker of the present invention is mechanically simple, and the height of the closed fuel lid can be easily adjusted by turning the casing or the bushing, or by turning the lock pin itself with a screw driver.

Though suitable embodiments of the present invention are described above, it is to be understood that the present invention is not limited to the above-mentioned embodiments, and various changes and modifications may be made in the invention without departing from the spirit and scope thereof.

What we claim is:

1. A striker for a lid of a fuel inlet chamber, comprising:

(a) a casing attached to the wall of a fuel inlet chamber in a rotatable manner along the longitudinal axis of the casing;

(b) a bushing supported by the end of the casing in a rotatable manner and securing said casing in a rotatable manner to said wall of the fuel inlet chamber;

(c) an elastic member for elastically urging the bushing against the casing such that the end of the casing and the bushing are abutted against ecah other with their contacting surfaces being perpendicular to their axes;

(d) a lock pin supported slidably in the axial direction of said casing so as to be projected into and withdrawn from the fuel inlet chamber through a hole formed at the end of the casing and a hole formed in said bushing, said hole at the end of said casing and said hole in said bushing being eccentric with respect to the rotational axes of said casing and said bushing;

(e) radial slots provided in one of the contacting surfaces of the bushing or the casing, and radial projections provided on another contacting surface of the bushing or the casing; the slots and the projections being engageable with each other and providing a means for locking a rotation of the bushing and casing to the wall and restricting the rotation of said lock pin on an aimed position while admitting said lock pin to move in the axial direction thereof;

(f) a spring for urging said lock pin in a forward direction such that the lock pin projects into the chamber; and (g) an operating member for withdrawing said lock pin backward.

2. A striker for a lid of a fuel inlet chamber, comprising:

(a) a casing attached to the wall of a fuel inlet chamber in a rotational manner along the longitudinal axis of the casing;

(b) a lock pin supported slidably in the axial direction of said casing so as to be projected into and withdrawn from the fuel inlet chamber, said lock pin being fixed on an end of a sliding member which is provided slidably and rotatably in the casing fixed to said wall and wherein the center axis of the lock pin is eccentric with respect to a rotational axis of the sliding member;

(c) a spring for urging said lock pin in a forward direction such that the lock pin projects into the chamber;

(d) an operating member for withdrawing said lock pin backward; and (e) a restricting means for restricting a rotation of said lock pin on an aimed position, while admitting said lock pin to move in the axial direction thereof, said restricting means locking the rotation of the sliding member when the lock pin is projected, while admitting rotation of the sliding member when the lock pin is withdrawn.

3. The striker of claim 2, wherein, said sliding member has a click member at a rear side end thereof; said click member is movable in an axial direction of the sliding member and is not rotatable with respect to the sliding member; a set of radial slots are provided on one of the bottom face of the casing or a rear face of the click member; and a set of radial projections for clicking with the slots are provided on another side of them.

* * * * *

UNITED STATES PATENT AND TRADEMARK OFFICE

CERTIFICATE OF CORRECTION

PATENT NO. : 5,048,878

DATED : September 17, 1991

INVENTOR(S) : Kazuhiro TAKESHITA et al

It is certified that error appears in the above-identified patent and that said Letters Patent is hereby corrected as shown below:

On the cover page, Item [30], line 1, delete

"Apr. 27, 1988 [JP] Japan . . . . . 63-57109[U]".

Signed and Sealed this

Twelfth Day of January, 1993

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,048,878

DATED : September 17, 1991

INVENTOR(S) : Kazuhiro TAKESHITA et al

It is certified that error appears in the above-identified patent and that said Letters Patent is hereby corrected as shown below:

On the cover page, Item [73], after "Takarazuka, Japan", please add -- HONDA GIKEN KOGYO KABUSHIKI KAISHA, Tokyo, Japan --.

Signed and Sealed this

Sixth Day of April, 1993

*Attest:*

STEPHEN G. KUNIN

*Attesting Officer*

*Acting Commissioner of Patents and Trademarks*